US011369988B2

(12) United States Patent
Karim et al.

(10) Patent No.: US 11,369,988 B2
(45) Date of Patent: Jun. 28, 2022

(54) METHODS FOR CURTAIN COATING SUBSTRATES

(71) Applicants: Dow Global Technologies LLC, Midland, MI (US); Regents of the University of Minnesota, Minneapolis, MN (US); Rohm and Haas Company, Collegeville, PA (US)

(72) Inventors: Alireza Mohammad Karim, Minneapolis, MN (US); Saswati Pujari, Collegeville, PA (US); Wieslaw J. Suszynski, Maple Plain, MN (US); Lorraine F. Francis, Minnetonka, MN (US); Marcio S. Carvalho, Minneapolis, MN (US); Vinita Yadav, Royersford, PA (US)

(73) Assignees: DOW GLOBAL TECHNOLOGIES LLC, Midland, MI (US); REGENTS OF THE UNIVERSITY OF MINNESOTA, Minneapolis, MN (US); ROHM AND HAAS COMPANY, Collegeville, PA (US)

( * ) Notice: Subject to any disclaimer, the term of this patent is extended or adjusted under 35 U.S.C. 154(b) by 0 days.

(21) Appl. No.: 17/042,787

(22) PCT Filed: Jan. 28, 2019

(86) PCT No.: PCT/US2019/015326

§ 371 (c)(1),
(2) Date: Sep. 28, 2020

(87) PCT Pub. No.: WO2019/190623

PCT Pub. Date: Oct. 3, 2019

(65) Prior Publication Data

US 2021/0016317 A1 Jan. 21, 2021

Related U.S. Application Data

(60) Provisional application No. 62/649,337, filed on Mar. 28, 2018.

(51) Int. Cl.

| | |
|---|---|
| ***B05D 1/30*** | (2006.01) |
| ***B05D 1/34*** | (2006.01) |
| ***B05D 7/00*** | (2006.01) |

(52) U.S. Cl.

CPC ..... *B05D 1/305* (2013.01); *B05D 1/34* (2013.01); *B05D 7/52* (2013.01); *B05D 2201/02* (2013.01); *B05D 2202/00* (2013.01); *B05D 2203/22* (2013.01); *B05D 2252/02* (2013.01); *B05D 2518/00* (2013.01)

(58) Field of Classification Search

None

See application file for complete search history.

(56) References Cited

U.S. PATENT DOCUMENTS 4,113,903 A 9/1978 Choinski
4,489,671 A 12/1984 Choinski (Continued)

FOREIGN PATENT DOCUMENTS

EP 0567071 10/1993
EP 0773472 5/1997

(Continued)

OTHER PUBLICATIONS

Becerra, "Chemical Engineering and Processing", p. 445-449, vol. 50.

(Continued)

*Primary Examiner* — Shamim Ahmed
*Assistant Examiner* — Bradford M Gates

(57) ABSTRACT

Methods of curtain coating substrates are disclosed. In some embodiments, the methods include applying two or more liquid layers simultaneously to a substrate, wherein the (Continued)

multiple layers include a bottom liquid layer comprising a shear thinning liquid, and another liquid layer comprising a viscoelastic liquid. In some embodiments, the disclosed methods include formulating a bottom layer liquid comprising a shear thinning liquid, formulating another layer liquid comprising a viscoelastic liquid, pumping the bottom layer liquid and the other layer liquid through coating dies simultaneously and onto a moving substrate such that the bottom layer liquid impinges on the substrate thereby forming a bottom layer, and the other layer liquid forms another liquid layer above the bottom liquid layer. The inclusion of a bottom liquid layer comprising a shear thinning liquid and other layer comprising a viscoelastic liquid provides for enlargement of the curtain coating window.

8 Claims, 6 Drawing Sheets

(56) References Cited

U.S. PATENT DOCUMENTS

| | | | | |
|---|---|---|---|---|
| 4,569,863 | A | 2/1986 | Koepke et al. | |
| 5,391,401 | A | 2/1995 | Blake et al. | |
| 5,972,591 | A | 10/1999 | Yarmey et al. | |
| 6,607,786 | B2 | 8/2003 | Katagiri et al. | |
| 7,976,904 | B2 | 7/2011 | Barcock et al. | |
| 8,552,132 | B2 | 10/2013 | Ghosh et al. | |
| 2002/0160121 | A1* | 10/2002 | Katagiri | B05C 5/008 427/420 |
| 2011/0200715 | A1* | 8/2011 | Fuisz | A23L 27/72 426/103 |

FOREIGN PATENT DOCUMENTS

| | | |
|---|---|---|
| EP | 0996033 | 4/2000 |
| WO | 199211094 | 7/1992 |

OTHER PUBLICATIONS

Gilbert, "Coatability of Viscoelastic Liquid Curtain", International Coating Science and Technology Symposium, 2010, Minnesota, USA.

PCT/US2019/015326, International Search Report and Written Opinion dated May 3, 2019.

PCT/US2019/015326, International Preliminary Report on Patentability dated Jan. 8, 2020.

* cited by examiner

METHODS FOR CURTAIN COATING SUBSTRATES

FIELD OF THE DISCLOSURE

The instant disclosure relates to methods of curtain coating substrates. In some embodiments, the disclosed methods include applying two or more liquid layers simultaneously to a substrate, wherein the multiple layers include a bottom liquid layer comprising a shear thinning liquid, and another liquid layer comprising a viscoelastic liquid.

In some embodiments, the disclosed methods include formulating a bottom layer liquid comprising a shear thinning liquid, formulating another layer liquid comprising a viscoelastic liquid, pumping the bottom layer liquid and the other layer liquid through coating dies simultaneously and onto a moving substrate such that the bottom layer liquid impinges on the substrate thereby forming a bottom layer, and the other layer liquid forms another liquid layer above the bottom liquid layer. The inclusion of a bottom liquid layer comprising a shear thinning liquid and other layer comprising a viscoelastic liquid provides for enlargement of the curtain coating window.

BACKGROUND AND SUMMARY OF THE DISCLOSURE

Curtain coating is a process to create a fluid coating on a moving substrate. The coated substrate can then be used for a variety of applications. A liquid curtain is formed by pumping the liquid(s) to be coated through a die, which creates a thin liquid sheet that falls under gravity until it impinges on a moving substrate, thereby forming a liquid layer. It is possible to create multilayer coatings as well as coatings on continuous substrates (i.e., webs) or discrete objects. Especially in continuous coatings, increasing the speed and decreasing the coating thickness are each important for the economics of the process. Despite the extensive variety of applications of curtain coating, its operation is challenging and uniform coating is only obtained in a certain range of operating parameters, called the coating window. The two main physical mechanisms that limit curtain coating are the breakup of the liquid curtain, below a critical flow rate, and air entrainment, which occurs above a certain web speed.

In the present disclosure, the curtain coating window is enlarged by using a multilayer approach in which a viscoelastic liquid layer with enhanced elasticity is simultaneously deposited with a shear thinning liquid layer via a multi-layer curtain coating approach. This allows for deposition of a thinner coating of the shear thinning liquid layer which impinges directly on a surface of the coated substrate.

Elasticity in the liquid to be coated (i.e., a viscoelastic liquid with significant extensional viscosity) increases the stability of the curtain during coating, which enables the process to run at a lower flow rate and create thinner coatings. That is, the elasticity in the liquid reduces the minimum flow rate, or the flow rate below which the curtain becomes unstable and breaks up into liquid columns. Further, the use of a shear thinning liquid (i.e., a liquid with a viscosity that decreases with increasing shear rate) can increase the range of coating speeds by delaying the onset of air entrainment to happen at relatively larger substrate speed.

By applying the aforementioned two types of liquids as a multilayer liquid curtain, where one layer in the multilayer liquid curtain comprises a liquid with elasticity and the bottom layer in the multilayer liquid curtain (i.e., lowermost or back liquid layer in the multilayer liquid curtain) comprises a shear thinning liquid, the size of the curtain window can be enlarged significantly. Enlarging the curtain window enables significant advantages in terms of operational procedures (e.g., coating speed) and increased product quality (e.g., lowering curtain thickness without any defects) when compared to existing coating methods.

Such methods of forming curtain coatings on substrates are disclosed herein. In some embodiments, methods of curtain coating a substrate are disclosed comprising applying two or more liquids simultaneously to respectively form multiple layers on the substrate, wherein the multiple layers include a bottom layer comprising a shear thinning liquid and an upper liquid layer comprising a viscoelastic liquid.

Further, methods of curtain coating a substrate are disclosed comprising formulating a bottom layer liquid comprising a shear thinning liquid, formulating an upper layer liquid comprising a viscoelastic liquid, pumping the bottom layer liquid and the upper layer liquid through coating dies simultaneously and onto a moving substrate such that the bottom layer liquid impinges on the substrate.

Still further, methods of curtain coating a substrate are disclosed comprising applying two or more liquids simultaneously to respectively form multiple layers on the substrate, wherein the multiple layers include a shear thinning liquid layer and a viscoelastic liquid layer, wherein the shear thinning liquid layer impinges a surface of the substrate. The disclosed methods can optionally an intermediate layer deposited in the curtain coating.

BRIEF DESCRIPTION OF THE DRAWINGS

Reference is made herein to the following Figures, of which.

DETAILED DESCRIPTION OF THE DISCLOSURE

Figure 1:
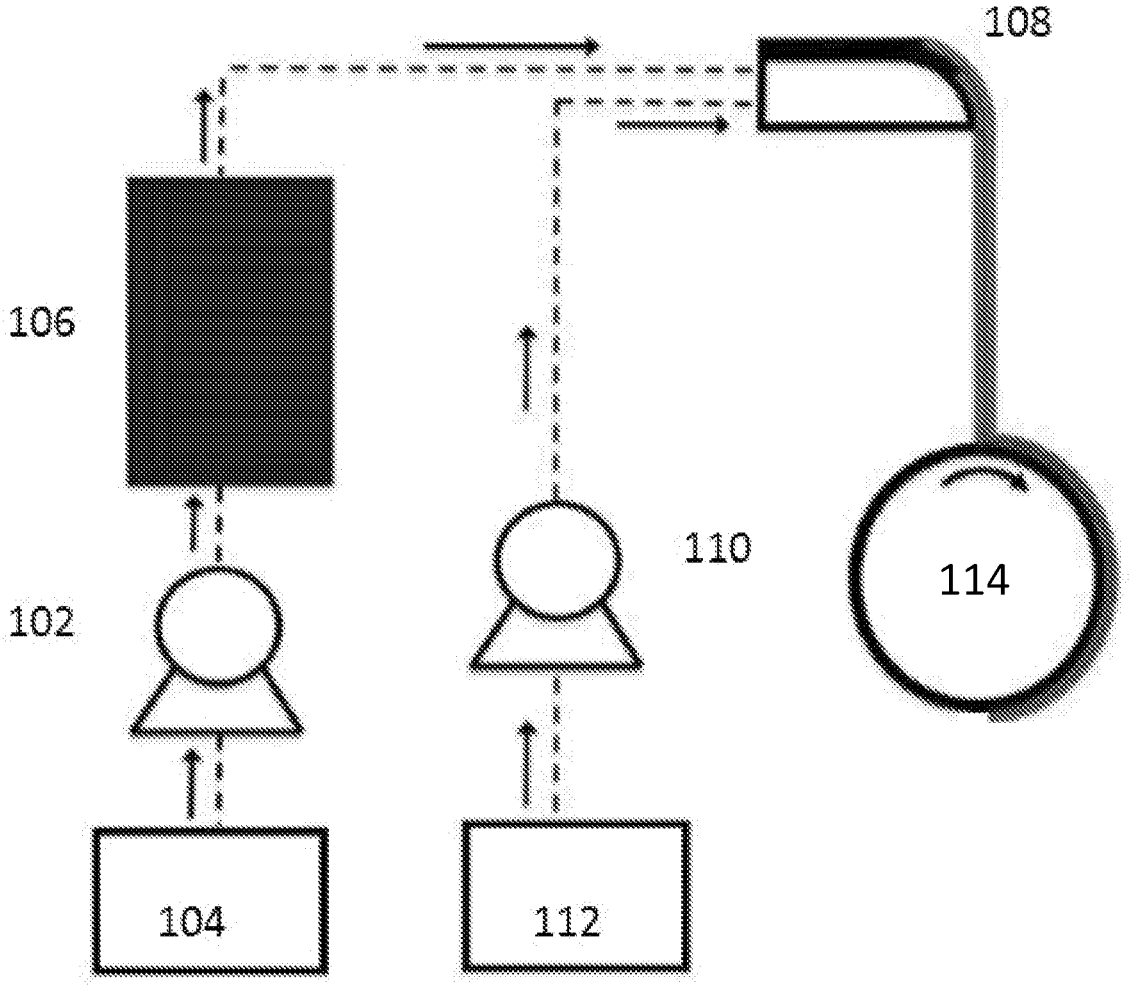
FIG. 1 shows a schematic representation of a curtain coating process according to this disclosure.

The disclosed methods provide for curtain coatings having improved speed ranges and stability compared to curtain coatings applied according to traditional approaches. As discussed above, the disclosed methods comprise applying two or more liquids simultaneously to respectively form multiple layers on a substrate. The multiple layers include a shear thinning liquid layer, or bottom liquid layer, that impinges directly on the substrate to be coated. The multiple layers further include a viscoelastic liquid layer that is oriented above the bottom liquid layer, i.e., an upper liquid layer relative to the bottom liquid layer, and not in direct contact with the substrate. The multiple layers may further include one or more intermediate liquid layers oriented above the bottom liquid layer. That is, the curtain coating can contain only two layers—a bottom liquid layer comprising a shear thinning liquid and an upper liquid layer comprising a viscoelastic liquid, or the curtain coating can contain three, four, five, or more layers provided that the bottommost liquid layer comprises a shear thinning liquid and one or more upper liquid layer(s) comprise a viscoelastic liquid. As used herein, "upper" does not necessarily mean "uppermost."

Shear Thinning Liquid Layer

The shear thinning liquid layer comprises a shear thinning liquid. As used herein, a shear thinning liquid is a liquid having a shear viscosity that decreases with increasing shear rate. The shear thinning liquid layer impinges directly on the substrate to be coated, as described in further detail below. In that regard, the shear thinning liquid layer is the bottom liquid layer in the curtain coating.

Examples of suitable shear thinning liquids for use according to this disclosure include aqueous solutions comprising xanthan gum, polymeric emulsions including acrylic emulsions, and polymer solutions which exhibit lower viscosity at increasing shear rates and extensional viscosity that does not rise significantly with extensional rate. For instance, and as further illustrated in the Examples, xanthan gum dissolved in distilled water is suitable for use in the shear thinning liquid layer according to this disclose. In some embodiments, the amount of xanthan gum present in the shear thinning liquid solution is from 0.1 to 1 percent by weight, or from 0.15 to 0.3 percent by weight, based on the total weight of the shear thinning liquid solution.

Viscoelastic Liquid Layer

The viscoelastic liquid layer comprises a viscoelastic liquid. As used herein, a viscoelastic liquid is a liquid exhibiting extensional thickening behavior such that it has extensional viscosity that rises with extension rate. The viscoelastic liquid layer is oriented above the shear thinning liquid layer, or bottom liquid layer. That is, the shear thinning liquid layer is oriented intermediate the substrate to be coated and the viscoelastic liquid layer. As illustrated in the Examples, this arrangement provides for enlargement of the coating window in various curtain coating applications. In some embodiments, the viscoelastic liquid has an extensional viscosity ($\mu_e$) of from 1 to 1050 Pa·s at high strains as measured using the CaBER rheometer technique, as detailed in Lucy E. Rodd, Timothy P. Scott, Justin J. Cooper-White, Gareth H. McKinley, "Capillary Break-up Rheometry of Low-Viscosity Elastic Fluids", HML Report Number 04-P-04, 2004. In some embodiments, the viscoelastic liquid has a surface tension ($\sigma$) of from 20 to 72 mN/m, as measured according to the Wilhelmy plate method.

Examples of suitable viscoelastic liquids for use according to this disclosure include, but are not limited to, aqueous solutions comprising elastic polymers such as high-molecular weight polyethylene oxide ("PEO"), polyvinyl alcohol ("PVOH"), poly(vinyl pyrrolidone) ("PVP"), and the like. For instance, PEO having a molecular weight of approximately $8\times10^6$ g/mol is suitable for use as a viscoelastic liquid according to this disclosure. In some embodiments, the amount of PEO present in the viscoelastic liquid solution is from 0.01 to 1 percent by weight, or from 0.025 to 0.1 percent by weight, or from 0.025 to 0.08 percent by weight, or from 0.025 to 0.05 percent by weight, based on the total weight of the viscoelastic liquid solution.

Optional Additives

In some embodiments, an additive can optionally be included in the shear thinning liquid layer and/or in the viscoelastic liquid layer. Examples of such additives include, but are not limited to, a wetting agent, a surfactant, a thickener, a defoamer, and combinations of two or more thereof.

Curtain Coating Formation

The above described liquid layers can be curtain coated on a substrate in various manners. Suitable substrates to be coated include, but are not limited to, paper substrates, polymeric film substrates, silicone-coated paper or film substrates, metal substrates, metallized film substrates, glass substrates, and cardboard substrates. Of these the preferred substrates include silicone-coated paper or film substrates.

FIG. 1 shows a schematic representation of a curtain coating process according to this disclosure. In FIG. 1, a pump 102 delivers viscoelastic liquid from a reservoir 104 to a mass flow meter (e.g., a Coriolis-type flow meter), which measures the mass flow rate and the density of the viscoelastic liquid before entering the slide coating die 108. The liquid exits the feed slot and flows down the inclined plane before forming the top-layer of the multilayer liquid curtain. A pump 110 delivers the shear thinning liquid from a reservoir 112 to the slide coating die 108. The shear thinning liquid also exits the feed slot and flows down the inclined plane before forming the bottom-layer of the multilayer curtain. The mass flow rate of the shear thinning solution can be determined by calibrating the pump 110. Both liquids flow down under gravitational acceleration until depositing on rotating cylinder 114.

EXAMPLES OF THE DISCLOSURE

The present disclosure will now be explained in further detail by describing examples illustrating the disclosed adhesive compositions and existing adhesive compositions (Illustrative Examples "IE", Comparative Examples "CE", collectively, "the Examples"). However, the scope of the present disclosure is not, of course, limited to the Examples.

Shear Thinning Liquid

Figure 2:
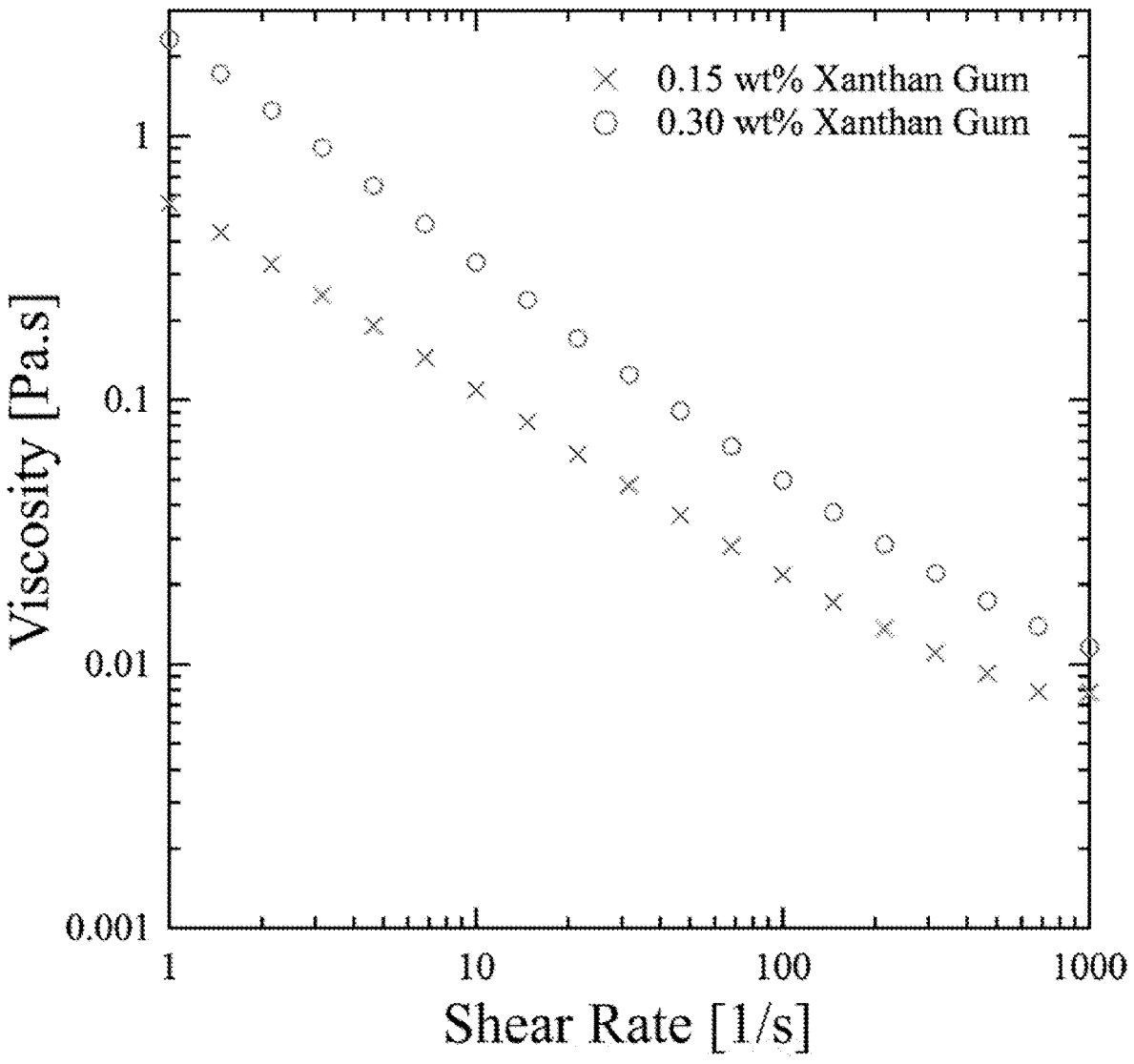
FIG. 2 shows a plot of viscosity versus shear rate for some shear thinning liquids.

Aqueous shear thinning solutions for use in the Examples are prepared in two concentrations (0.15 and 0.30 wt %, based on the total weight of the aqueous solution) by dissolving xanthan gum in distilled water. Then, the 2.7 mM sodium dodecyl sulfate ("SDS") and a small amount of food-grade blue #1 color dye are added and stirred in the solution The xanthan gum solutions exhibit shear thinning behavior as detailed in FIG. 2. Different xanthan gum concentrations in the same solvent (i.e., distilled water) have similar high-shear viscosity, $\mu_{1000}$, with different low-shear viscosity, $\mu_0$.

The surface tension of the solutions is measured using the Wilhelmy plate method in a K10ST™ digital tensiometer available from Krüss. The shear viscosity curves are obtained using a AR-G2™ rheometer available from TA Instruments with a Couette cell geometry. Densities are measured with a volumetric flask and a laboratory balance. The extensional viscosities, $\mu_e$, of the shear thinning solutions are too low to measure using the Capillary Break-up Extensional Rheometer ("CaBER") rheometer method because of quick breakup of the liquid filament.

Table 1 details the surface tension and viscosities of these shear thinning solutions.

TABLE 1

Physical properties of shear thinning solutions

| Xanthan Gum [wt %] | Distilled water [wt %] | Density [kg/m$^3$] | Surface Tension [mN/m] | Viscosity [mPa · s] |
|---|---|---|---|---|
| 0.15 | 99.85 | 994.0 ± 2.0 | 39.1 | 559.9 – 7.8 |
| 0.30 | 99.70 | 974.0 ± 1.9 | 42.2 | 2322.0 – 11.6 |

The apparent extensional viscosity of the viscoelastic liquid solutions is probed using the CaBER method. The relaxation time, λ, for the current solutions varies from 74 to 764 ms based on the polyethylene oxide concentration.

The extensional viscosity can be represented by the Trouton ratio, Tr, which represents the ratio between the extensional viscosity to shear viscosity:

$$Tr \equiv \frac{\mu_e}{\mu_0}. \tag{3}$$

Figure 4:
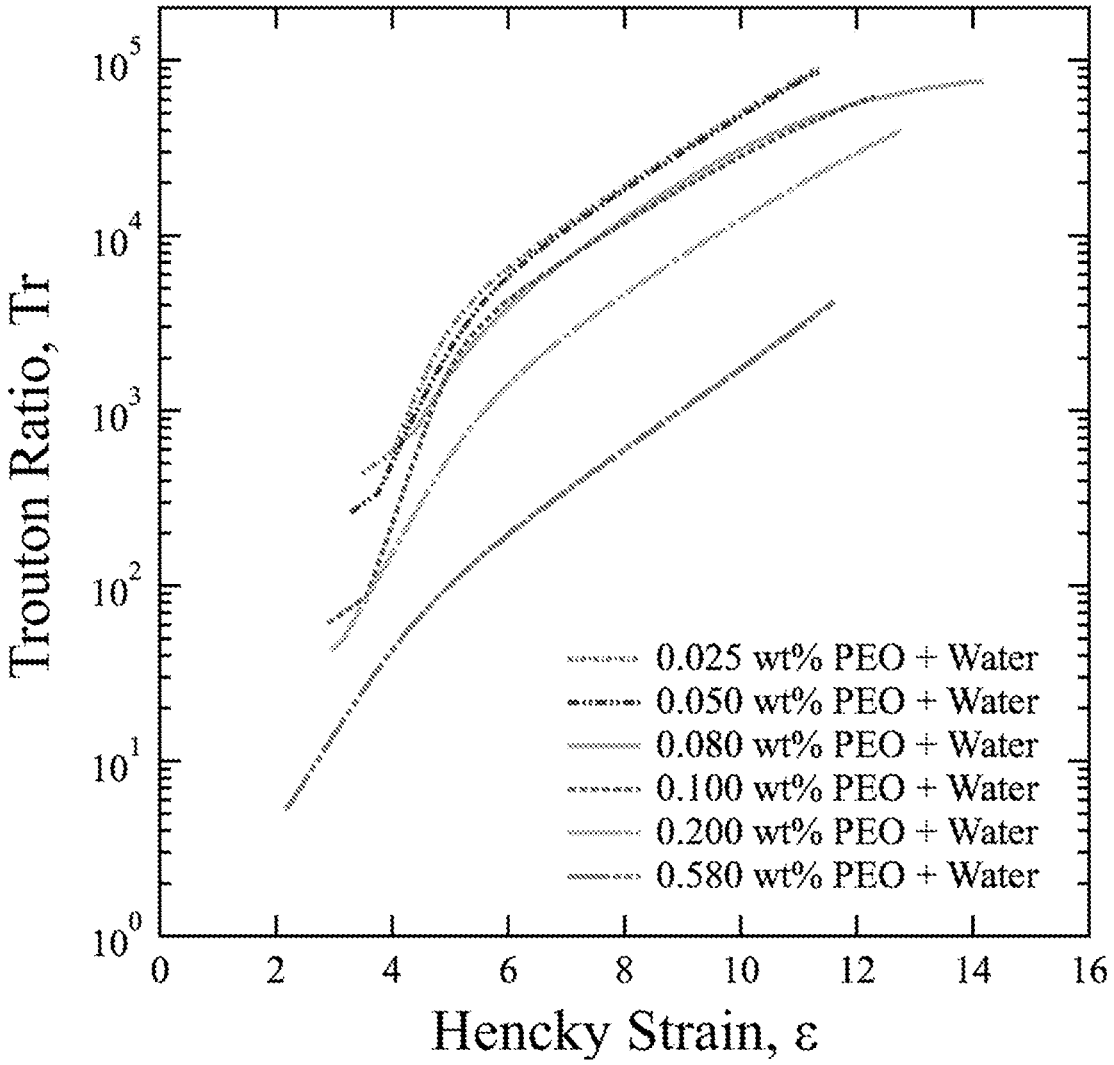
FIG. 4 shows a plot of extensional viscosity, represented in terms of the Trouton ratio, versus Hencky strain for some viscoelastic solutions.

Trouton ratio versus Hencky strain, ε, defined as $$\varepsilon \equiv -2\ln\left(\frac{D}{D_p}\right),$$

where $D_p$ is the initial diameter of the liquid bridge are presented in FIG. 4.

The physical properties (e.g., extensional viscosity at high strain) for all viscoelastic liquid solutions used in the Examples are presented in Table 2.

TABLE 2

Physical properties of the viscoelastic liquids

| [wt %] PEO-8 × 10$^6$ g/mol | ρ [kg/m$^3$] | σ [mN/m] | $\mu_0$ [mPa · s] | $\mu_s$ [mPa · s] | $\mu_p$ [mPa · s] | $\frac{\mu_p}{\mu_s}$ | $\mu_e$ [Pa · s] | λ [ms] |
|---|---|---|---|---|---|---|---|---|
| 0.025 | 993.3 ± 0.7 | 38.2 | 3.8 | 1.5 | 2.3 | 1.5 | 339.5 | 73.0 |
| 0.050 | 994.1 ± 0.2 | 38.6 | 6.7 | 1.5 | 5.2 | 3.5 | 574.8 | 126.4 |
| 0.080 | 994.1 ± 0.1 | 37.9 | 9.8 | 1.5 | 8.3 | 5.5 | 742.5 | 118.2 |
| 0.100 | 993.8 ± 0.2 | 38.0 | 17.1 | 1.5 | 15.6 | 10.4 | 1060.7 | 217.7 |
| 0.200 | 993.8 ± 0.1 | 38.3 | 75.4 | 1.5 | 73.9 | 49.3 | 2972 | 371 |
| 0.580 | 993.1 ± 0.1 | 38.2 | 1287.0 | 1.5 | 1285.5 | 857 | 5274.1 | 763.7 |

Viscoelastic Liquid

Figure 3:
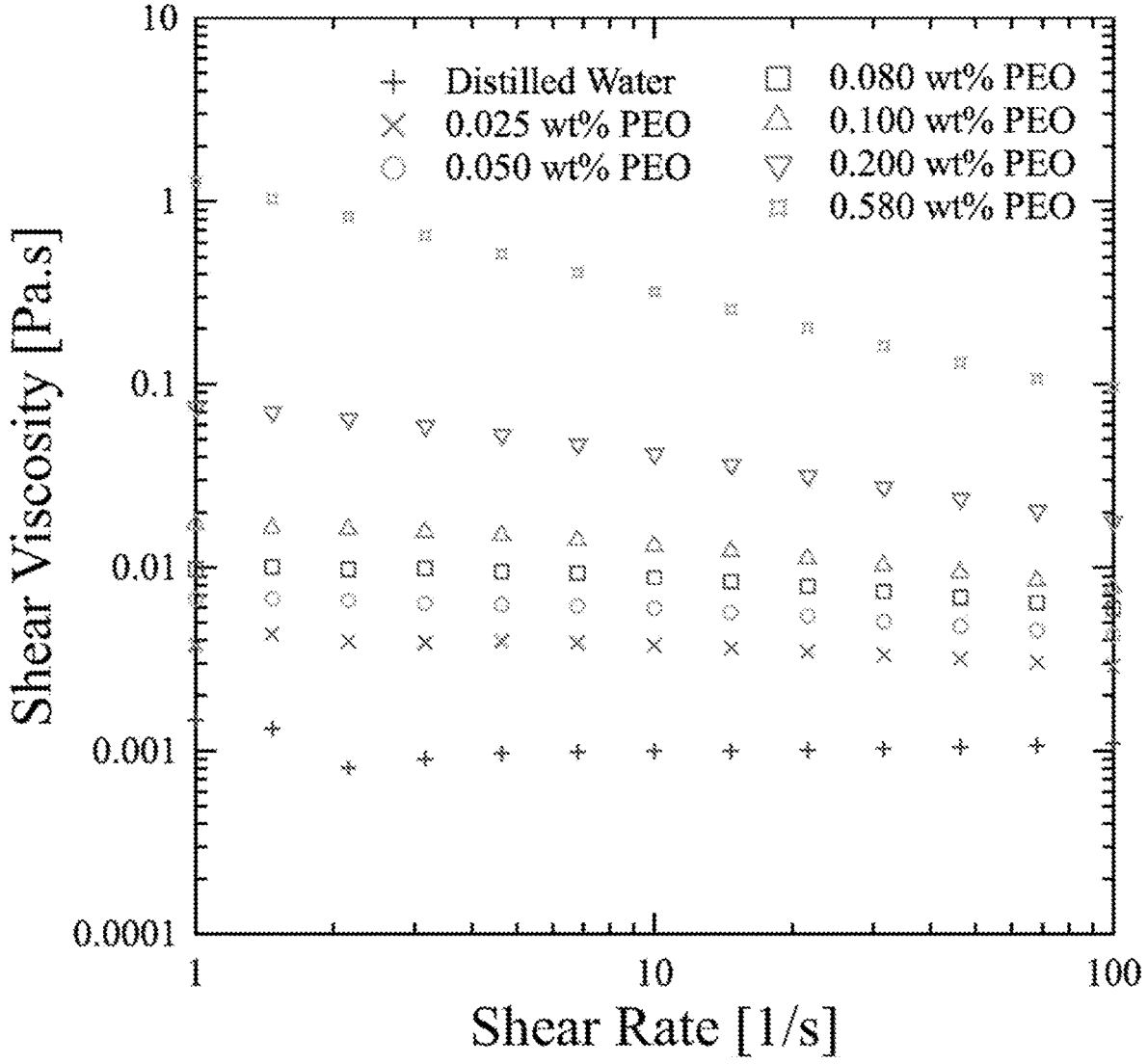
FIG. 3 shows a plot of shear viscosity versus shear rate for some viscoelastic liquids.

Aqueous solutions of polyethylene oxide (molecular weight of approximately 8×10$^6$ g/mol) are used as the viscoelastic liquids in the Examples. Small amounts of the high-molecular weight polymer polyethylene oxide is added to the distilled water to obtain the viscoelastic liquid. The surface tension of the viscoelastic liquid solutions is reduced by adding a surfactant (2.77 mM of SDS). A small amount of food grade red #40 color dye is added to the solution to distinguish the viscoelastic liquid layer from the shear thinning liquid layer (blue) in the double-layer curtain. The surface tension is measured using the Wilhelmy plate method in a K10ST™ digital tensiometer available from Krüss. The shear viscosity curves are obtained using the AR-G2™ rheometer available from TA Instruments with a Couette cell geometry. The density is measured by a Coriolis type mass flow meter used in the curtain coating setup. FIG. 3 shows the shear viscosity of the viscoelastic liquid solutions as a function of shear rate. The polyethylene oxide contribution to the shear viscosity, $\mu_p$, is defined as the difference between the viscoelastic liquid solution and the solvent (i.e., distilled water) viscosities, e.g., $\mu_p \equiv \mu_0 - \mu_s$.

Shear Thinning Liquid with Viscoelasticity

Figure 5:
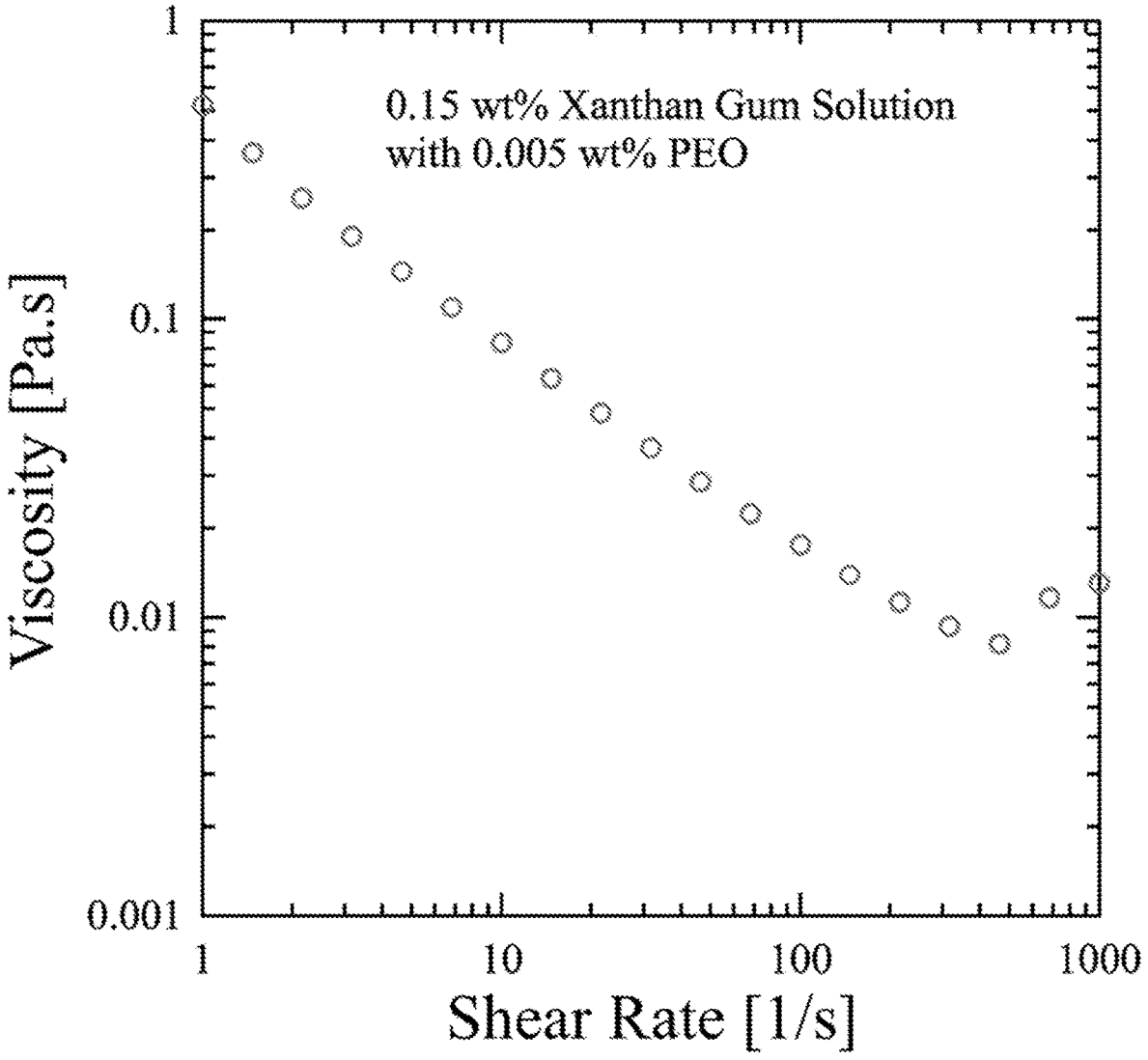
FIG. 5 shows a plot of viscosity versus shear rate for shear thinning liquid solution including a small amount of PEO.
Figure 6:
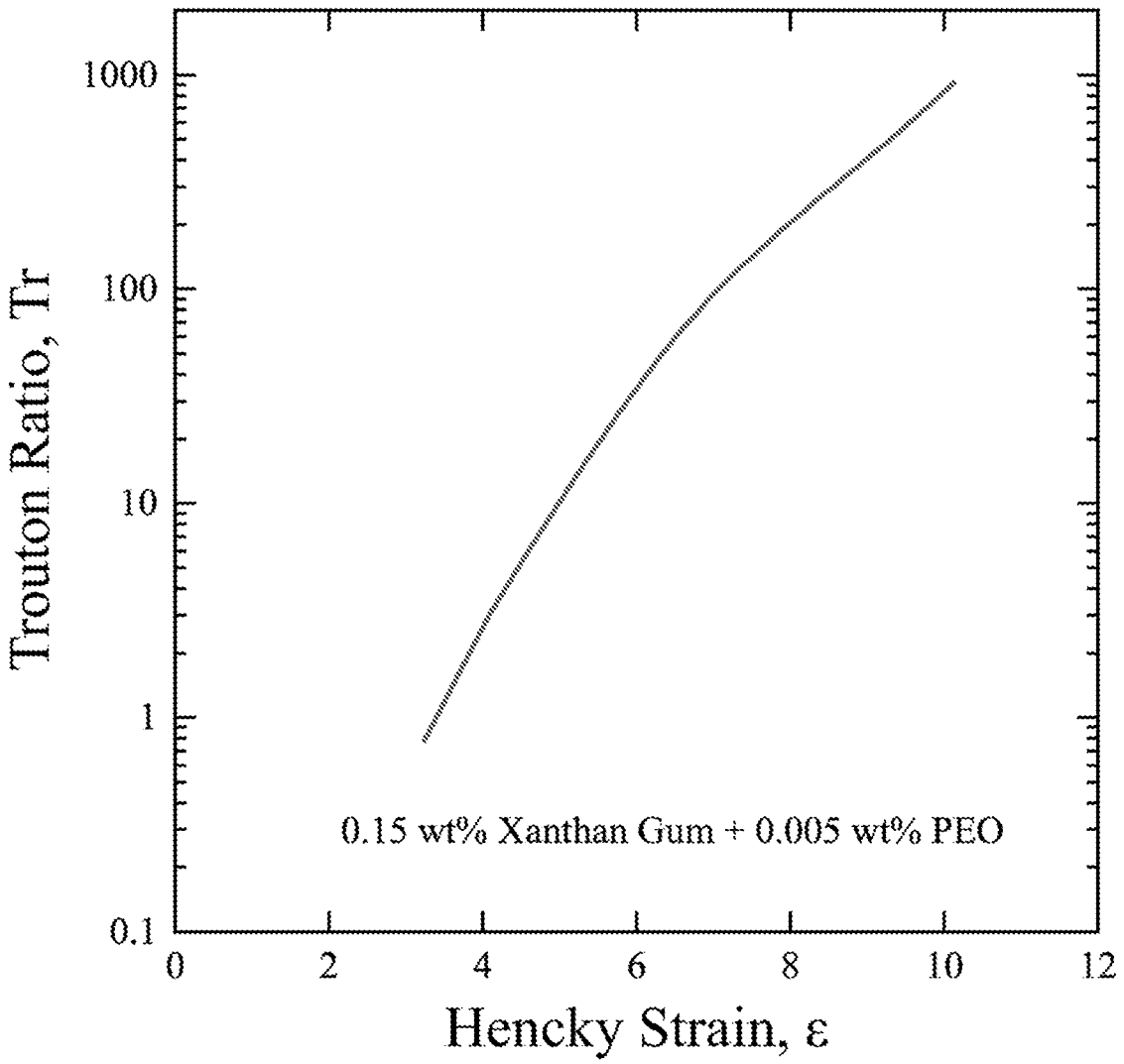
FIG. 6 shows a plot of extensional viscosity, represented in terms of the Trouton ratio, versus Hencky strain for shear thinning liquid solution including small amount of PEO.

A shear thinning liquid with viscoelasticity for use in the Examples is prepared in a concentration 0.15 wt % by dissolving xanthan gum in 99.85 distilled water and 0.005 wt % PEO. Then, the 2.7 mM SDS and a small amount of food-grade blue #1 color dye are added and stirred in the solution. Finally, 0.005 wt % PEO is added slowly in the solution. The xanthan gum/PEO solution exhibits shear thinning behavior with viscoelasticity as shown in FIGS. 5 and 6. Table 3 details the physical properties of the shear thinning liquid with viscoelasticity.

The surface tension of the shear thinning solutions with viscoelasticity is measured using the Wilhelmy plate method in a K10ST™ digital tensiometer available from Krüss. The shear viscosity, μ, curves were obtained using the AR-G2™ rheometer available from TA Instruments with a Couette cell geometry. Densities are measured with a volumetric flask and a laboratory balance.

TABLE 3

| Physical properties of shear thinning liquid with viscoelasticity | | | | | | | |
|---|---|---|---|---|---|---|---|
| Xanthan Gum [wt %] | Distilled water [wt %] | PEO [wt %] | ρ [kg/m$^3$] | σ [mN/m] | μ [mPa · s] | $\mu_e$ [Pa · s] | λ [ms] |
| 0.15 | 99.85 | 0.005 | 994.0 ± 0.2 | 41.4 | 520.1 – 13.1 | 481.9 | 98.9 |

Newtonian Liquid Solution

Aqueous solutions of polyethylene glycol (PEG, 8000 g/mol) are used as the Newtonian liquid in the Examples. PEG solution is prepared in 20 wt % concentration by dissolving PEG powder in distilled water. Then, the 2.77 mM sodium dodecyl sulfate (SDS) and a small amount of food grade red #40 color dye are added and stirred in the solution The PEG solution exhibits Newtonian behavior. Table 4 details the physical properties of the PEG solution. The extensional viscosity of PEG solution could not be measured using CaBER. Since the PEG solution exhibits Newtonian behavior, its Trouton ratio was assumed to be 3. The extensional viscosity of the 20 wt % PEG solutions is estimated to be about 0.06 Pa·s.

TABLE 4

| Physical properties of Newtonian Liquid | | | | | |
|---|---|---|---|---|---|
| PEG [wt %] | Distilled water [wt %] | ρ [kg/m$^3$] | σ [mN/m] | μ [mPa · s] | $\mu_e$ [Pa · s] |
| 20 | 80 | 1028.7 ± 0.2 | 39.5 | 20.5 – 20.5 | 0.06 |

The Examples detailed in the Table 5 detail how the combination of a shear thinning bottom liquid layer with a viscoelastic upper liquid layer ($1<\mu_e<1050$ Pa·s) results in enhanced curtain stability, i.e., lower accessible minimum flow rate ($Q_{min}$). Both the single layer curtains with the xanthan gum solutions (CE1 and CE2) result in higher minimum flow rate than the double layer curtains containing these fluids as the bottom liquid layer and the 0.025 to 0.1 wt % PEO solutions as the upper liquid layer (IE1 to IE6).

Higher concentration of PEO (CE3 to CE8), resulting in $\mu_e>1050$ Pa·s, results in bead pulling such that the liquid curtain is pulled along with the moving web (glass roller in Examples setup, as schematically illustrated in FIG. 1) at lower speed than the maximum speed of the roller (164.2 cm/s) as indicated in Table 5.

The improved curtain stability is not observed if the upper liquid layer is thickened with PEG to improve curtain stability instead of PEO (i.e., Newtonian but no extensional viscosity as the upper liquid layer), as shown by CE9 which is prepared by using the 20 wt % PEG solution as the upper liquid layer and 0.15 wt % xanthan gum solution as the bottom liquid layer. The minimum total flow rate, $Q_{min}$, for this case, equals $Q_{min}$=(16.12±0.61) cm$^3$/s where the minimum flow rate for 20 wt % PEG layer alone is very large equals 5.74 cm$^3$/s. In comparison, the total minimum flow rate, $Q_{min}$, of the double layer with the bottom liquid layer with the 0.15 wt % xanthan gum solution and the upper liquid layer with the 0.025 wt % PEO solution, is $Q_{min}$=(14.56±1.8) cm$^3$/s with the minimum flow rate of the 0.025 wt % PEO layer to be only 0.66 cm$^3$/s.

Where a small amount of PEO is added to the bottom liquid layer, resulting in increased extensional viscosity, bead pulling and air entrainment is observed and the bead pulling pulls the curtain forward as the speed of the glass roller increases. The double layer in CE 10 is produced using 0.15 wt % xanthan gum with very small amount of PEO (i.e., 0.005 wt % PEO) as a bottom liquid layer and viscoelastic solution (i.e., 0.025 wt % PEO) as a upper liquid layer. The bead pulling is observed and the extent of the bead pulling becomes larger as the speed of the glass roller increases.

Table 5 details the minimum flow rates for the various Examples. For Examples using a double-layer curtain coating, the minimum flow rates of each layer are detailed in addition to the total minimum flow rate, which is the sum of the individual layers.

TABLE 5

| Minimum Flow Rates | | |
|---|---|---|
| | Comparative Examples: Single-layer approach | |
| CE1 | 0.15 wt % Xanthan gum solution<br>$Q_{min}$ = 17.9 ± 0.2 cm$^3$/s | |
| CE2 | 0.30 wt % Xanthan gum solution<br>$Q_{min}$ = 16.7 ± 0.7 cm$^3$/s | |
| | Top-Layer (Viscoelastic) | Bottom-Layer (Shear Thinning) |
| | Illustrative Examples: Double-layer approach | |
| IE1 | 0.025 wt % PEO ($\mu_e$ = 339.5)<br>Q = 0.66 cm$^3$/s<br>Total $Q_{min}$ = 14.56 ± 1.8 cm$^3$/s | 0.15 wt % Xanthan<br>Q = 13.9 ± 1.8 cm$^3$/s |
| IE2 | 0.050 wt % PEO ($\mu_e$ = 574.8)<br>Q = 0.66 cm$^3$/s<br>Total $Q_{min}$ = 10.26 ± 0.2 cm$^3$/s | 0.15 wt % Xanthan<br>Q = 9.6 ± 0.2 cm$^3$/s |
| IE3 | 0.080 wt % PEO ($\mu_e$ = 742.5)<br>Q = 0.66 cm$^3$/s<br>Total $Q_{min}$ = 8.16 ± 0.4 cm$^3$/s | 0.15 wt % Xanthan<br>Q = 7.5 ± 0.4 cm$^3$/s |
| IE4 | 0.025 wt % PEO($\mu_e$ = 339.5)<br>Q = 0.66 cm$^3$/s<br>Total $Q_{min}$ = 12.06 ± 0.7 cm$^3$/s | 0.30 wt % Xanthan<br>Q = 11.4 ± 0.7 cm$^3$/s |
| IE5 | 0.050 wt % PEO ($\mu_e$ = 574.8)<br>Q = 0.66 cm$^3$/s<br>Total $Q_{min}$ = 10.06 ± 0.3 cm$^3$/s | 0.30 wt % Xanthan<br>Q = 9.4 ± 0.3 cm$^3$/s |
| IE6 | 0.080 wt % PEO ($\mu_e$ = 742.5)<br>Q = 0.66 cm$^3$/s<br>Total $Q_{min}$ = 10.76 ± 0.3 cm$^3$/s | 0.30 wt % Xanthan<br>Q = 10.1 ± 0.3 cm$^3$/s |
| | Comparative Examples: Double-layer approach | |
| CE3 | 0.100 wt % PEO ($\mu_e$ = 1060.7)<br>Q = 0.66 cm$^3$/s<br>Total $Q_{min}$ = 6.76 ± 0.8 cm$^3$/s<br>Bead Pulling at 43.8 cm/s | 0.15 wt % Xanthan<br>Q = 6.1 ± 0.8 cm$^3$/s |
| CE4 | 0.200 wt % PEO ($\mu_e$ = 2972)<br>Bead Pulling at 21.9 cm/s | 0.15 wt % Xanthan |
| CE5 | 0.580 wt % PEO ($\mu_e$ = 5274.1)<br>Bead Pulling at 10.9 cm/s | 0.15 wt % Xanthan |
| CE6 | 0.100 wt % PEO ($\mu_e$ = 1060.7)<br>Q = 0.66 cm$^3$/s<br>Total $Q_{min}$ = 9.96 ± 0.7 cm$^3$/s<br>Bead Pulling at 43.8 cm/s | 0.30 wt % Xanthan<br>Q = 9.3 ± 0.7 cm$^3$/s |
| CE7 | 0.200 wt % PEO ($\mu_e$ = 2972)<br>Bead Pulling at 43.8 cm/s | 0.30 wt % Xanthan |
| CE8 | 0.580 wt % PEO ($\mu_e$ = 5274.1)<br>Bead Pulling at 21.9 cm/s | 0.30 wt % Xanthan |
| CE89 | 20 wt % PEG ($\mu_e$ = 0.06)<br>Q = 5.74 cm$^3$/s<br>Total $Q_{min}$ = 16.12 ± 0.61 cm$^3$/s | 0.15 wt % xanthan<br>Q = 10.38 ± 0.61 cm$^3$/s |

TABLE 5-continued

| Minimum Flow Rates | | |
|---|---|---|
| CE10 | 0.025 wt % PEO ($\mu_e$ = 339.5) PEO ($\mu_e$ = 481.9) Results in bead pulling | 0.15 wt % Xanthan + 0.005 wt % |

In addition to the embodiments described above, many embodiments of specific combinations are within the scope of the disclosure, some of which are described below:

Embodiment 1. A method of curtain coating a substrate, comprising:

applying two or more liquids simultaneously to respectively form multiple layers on the substrate, wherein the multiple layers include:

a bottom liquid layer comprising a shear thinning liquid; and an upper liquid layer comprising a viscoelastic liquid.

Embodiment 2. The method of any preceding or succeeding Embodiment, wherein the shear thinning liquid has an apparent viscosity that decreases with increasing shear rate.

Embodiment 3. The method of any preceding or succeeding Embodiment, wherein the shear thinning liquid comprises xanthan gum in an aqueous solution.

Embodiment 4. The method of any preceding or succeeding Embodiment, wherein the shear thinning liquid comprises xanthan gum in an amount from 0.1 to 1 percent by weight, based on the total weight of the shear thinning liquid.

Embodiment 5. The method of any preceding or succeeding Embodiment, wherein the shear thinning liquid comprises xanthan gum in an amount from 0.15 to 0.3 percent by weight, based on the total weight of the shear thinning liquid.

Embodiment 6. The method of any preceding or succeeding Embodiment, wherein the viscoelastic liquid comprises polyethylene oxide in an amount from 0.01 to 1 percent by weight, based on the total weight of the viscoelastic liquid.

Embodiment 7. The method of any preceding or succeeding Embodiment, wherein the viscoelastic liquid comprises polyethylene oxide in an amount from 0.025 to 0.1 percent by weight, based on the total weight of the viscoelastic liquid.

Embodiment 8. The method of any preceding or succeeding Embodiment, wherein the viscoelastic liquid comprises polyethylene oxide in an amount from 0.025 to 0.08 percent by weight, based on the total weight of the viscoelastic liquid.

Embodiment 9. The method of any preceding or succeeding Embodiment, wherein the viscoelastic liquid comprises polyethylene oxide in an amount from 0.025 to 0.05 percent by weight, based on the total weight of the viscoelastic liquid.

Embodiment 10. The method of any preceding or succeeding Embodiment, wherein the viscoelastic liquid has an extensional viscosity of from 1 to 1050 Pa·s.

Embodiment 11. The method of any preceding or succeeding Embodiment, wherein the viscoelastic liquid has surface tension of from 20 to 72 mN/m.

Embodiment 12. The method of any preceding or succeeding Embodiment, wherein the substrate comprises a material selected from the group consisting of paper, polymeric film, silicone-coated paper, metal, and metallized film.

Embodiment 13. A method of curtain coating a substrate, comprising:

formulating a bottom liquid layer comprising a shear thinning liquid;

formulating an upper liquid layer comprising a viscoelastic liquid;

pumping the bottom liquid layer and the upper liquid layer through coating dies simultaneously and onto a moving substrate such that the bottom liquid layer impinges on the substrate.

Embodiment 14. A method of curtain coating a substrate, comprising:

applying two or more liquids simultaneously to respectively form multiple layers on the substrate, wherein the multiple layers include:

a shear thinning liquid layer comprising a shear thinning liquid having a shear viscosity that decreases with increasing shear rate; and a viscoelastic liquid layer comprising a viscoelastic liquid, wherein the shear thinning liquid layer impinges a surface of the substrate.

Embodiment 15. The method of any preceding or succeeding Embodiment, further comprising an intermediate liquid layer.

The invention claimed is:

1. A method of curtain coating a substrate, comprising:

applying two or more liquids simultaneously to respectively form multiple layers on the substrate, wherein the multiple layers include:

a bottom liquid layer comprising a shear thinning liquid; and an upper liquid layer comprising a viscoelastic liquid, wherein the viscoelastic liquid comprises polyethylene oxide in an amount from 0.01 to 1 percent by weight, based on the total weight of the viscoelastic liquid, and has an extensional viscosity of from 1 to 1,050 Pa·s.

2. The method of claim 1, wherein the shear thinning liquid comprises xanthan gum in an aqueous solution.

3. The method of claim 1, wherein the shear thinning liquid comprises xanthan gum in an amount from 0.1 to 1 percent by weight, based on the total weight of the shear thinning liquid.

4. The method of claim 1, wherein the viscoelastic liquid has surface tension of from 20 to 72 mN/m.

5. The method of claim 1, wherein the substrate comprises a material selected from the group consisting of paper, polymeric film, silicone-coated paper, metal, and metallized film.

6. The method of claim 1, further comprising applying an intermediate liquid layer between the upper liquid layer and bottom liquid layer.

7. A method of curtain coating a substrate, comprising:

formulating a bottom liquid layer comprising a shear thinning liquid;

formulating an upper liquid layer comprising a viscoelastic liquid, wherein the viscoelastic liquid comprises polyethylene oxide in an amount from 0.01 to 1 percent by weight, based on the total weight of the viscoelastic liquid, and has an extensional viscosity of from 1 to 1,050 Pa·s;

pumping the bottom liquid layer and the upper liquid layer through coating dies simultaneously and onto a moving substrate such that the bottom liquid layer impinges on the substrate.

8. A method of curtain coating a substrate, comprising:

applying two or more liquids simultaneously to respectively form multiple layers on the substrate, wherein the multiple layers include:

a shear thinning liquid layer comprising a shear thinning liquid having a shear viscosity that decreases with increasing shear rate; and a viscoelastic liquid layer comprising a viscoelastic liquid, wherein the viscoelastic liquid comprises polyethylene oxide in an amount from 0.01 to 1 percent by weight, based on the total weight of the viscoelastic liquid, and has an extensional viscosity of from 1 to 1,050 Pa·s, wherein the shear thinning liquid layer impinges a surface of the substrate.

* * * * *